US011225376B1

(12) United States Patent
King

(10) Patent No.: US 11,225,376 B1
(45) Date of Patent: Jan. 18, 2022

(54) TRASHCAN SYSTEM AND METHOD OF USE

(71) Applicant: Tammi Shantal King, Baytown, TX (US)

(72) Inventor: Tammi Shantal King, Baytown, TX (US)

( * ) Notice: Subject to any disclaimer, the term of this patent is extended or adjusted under 35 U.S.C. 154(b) by 0 days.

(21) Appl. No.: 16/523,438

(22) Filed: Jul. 26, 2019

Related U.S. Application Data

(60) Provisional application No. 62/703,704, filed on Jul. 26, 2018.

(51) Int. Cl.
*B65F 1/02* (2006.01)
*B65F 1/16* (2006.01)
*B65F 1/14* (2006.01)

(52) U.S. Cl.
CPC ..... *B65F 1/02* (2013.01); *B65F 1/1452* (2013.01); *B65F 1/1473* (2013.01); *B65F 1/16* (2013.01); *B65F 2210/16* (2013.01)

(58) Field of Classification Search
CPC ..... B65F 1/00; B65F 1/02; B65F 1/04; B65F 1/12; B65F 1/16; B65F 1/1452; B65F 1/1473; B65F 2210/16
See application file for complete search history.

(56) References Cited

U.S. PATENT DOCUMENTS 5,184,744 A * 2/1993 Paulison ..... B65F 1/0053 220/23.4
5,356,027 A * 10/1994 Craft ..... B65F 1/1646 16/257
D355,741 S * 2/1995 Craft ..... D34/1
5,547,104 A * 8/1996 Parker ..... B65F 1/1468 220/772
6,651,992 B1 * 11/2003 Smith, Sr. ..... B62B 1/125 16/113.1
6,833,789 B1 * 12/2004 Carmen ..... B65F 1/1607 324/239
7,100,791 B2 * 9/2006 Berger ..... B65F 1/122 220/380
8,079,489 B1 * 12/2011 Welch ..... B65F 7/00 220/495.04
8,096,565 B2 * 1/2012 Meers ..... B65F 1/122 280/47.26
8,714,404 B2 * 5/2014 Raghunathan ..... B65F 1/1468 220/770
8,807,579 B2 * 8/2014 Lin ..... B65F 1/1468 280/47.131
8,870,021 B2 * 10/2014 Smyers ..... A47G 19/26 220/784
9,098,884 B2 * 8/2015 Borowski ..... G06Q 90/00
9,347,817 B2 * 5/2016 Pollock ..... A61B 5/208
9,371,181 B2 * 6/2016 Connor ..... B65F 1/1646
9,530,154 B2 * 12/2016 Free ..... G06Q 30/0273
(Continued)

*Primary Examiner* — Timothy L Maust

(74) *Attorney, Agent, or Firm* — Leavitt Eldredge Law Firm

(57) ABSTRACT

A trashcan system includes a body forming an interior cavity; a lid engaged with the body to enclose the interior cavity; a control system secured to the body and having a speaker; the control system is to wirelessly communicate with a smart device; the control system activates playing of audio from the smart device through the speaker when the smart device is within a predetermined distance from the control system.

7 Claims, 3 Drawing Sheets

(56) References Cited

U.S. PATENT DOCUMENTS

| | | | | |
|---|---|---|---|---|
| 9,840,368 | B1 * | 12/2017 | Bennett | B65F 1/0053 |
| 10,037,679 | B1 * | 7/2018 | Crosby | B65F 1/14 |
| 10,266,340 | B2 * | 4/2019 | Uffner | B65F 1/1452 |
| 10,377,565 | B2 * | 8/2019 | Skocypec | B65F 1/12 |
| 10,382,915 | B2 * | 8/2019 | Rodoni | H04W 4/023 |
| 2009/0173656 | A1 * | 7/2009 | Furlong | B65D 21/022 206/508 |
| 2010/0096389 | A1 * | 4/2010 | Volpe | B65F 1/068 220/501 |
| 2013/0169441 | A1 * | 7/2013 | Wilson | A01K 27/009 340/573.3 |
| 2013/0278067 | A1 * | 10/2013 | Poss | B65F 1/1468 307/62 |
| 2014/0091088 | A1 * | 4/2014 | Hay | B65F 1/122 220/200 |
| 2014/0367292 | A1 * | 12/2014 | Bonello | G09F 15/0043 206/459.1 |
| 2016/0194112 | A1 * | 7/2016 | Dziaba | B65D 43/0204 206/505 |
| 2017/0096299 | A1 * | 4/2017 | Yang | B65F 1/1638 |
| 2017/0284077 | A1 * | 10/2017 | Deurloo | B01D 29/96 |
| 2017/0297837 | A1 * | 10/2017 | Burns | B62B 3/005 |
| 2017/0313509 | A1 * | 11/2017 | Mshamma | B65F 1/1638 |
| 2018/0022544 | A1 * | 1/2018 | Donnelly | B29C 49/04 220/605 |
| 2019/0071247 | A1 * | 3/2019 | Dzirbik | B65F 1/1468 |
| 2020/0284073 | A1 * | 9/2020 | Thomas, II | B65D 88/128 |

* cited by examiner

TRASHCAN SYSTEM AND METHOD OF USE

BACKGROUND

1. Field of the Invention

The present invention relates generally to trashcans, and more specifically, to a trashcan system for connecting to a phone or other smart device to allow for hands free phone use while maneuvering of the trashcan.

2. Description of Related Art

Trashcans are well known in the art and are effective means to store and transport waste. For example, FIG. 1 depicts a conventional trashcan 101 having a body 103 with a lid 105. During use, the waste is placed within the body 103 until full, at which time the user may take the trashcan 101 to dump into a larger container, such as a dumpster.

One of the problems commonly associated with trashcan 101 is inconvenience. For example, it is generally difficult for a user to dump trashcan 101 into a dumpster. Further, if the user is talking on their phone, or other device, and the trashcan needs to be emptied, they must generally either end the call or maneuver the phone and trashcan at the same time.

Accordingly, although great strides have been made in the area of trashcans, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
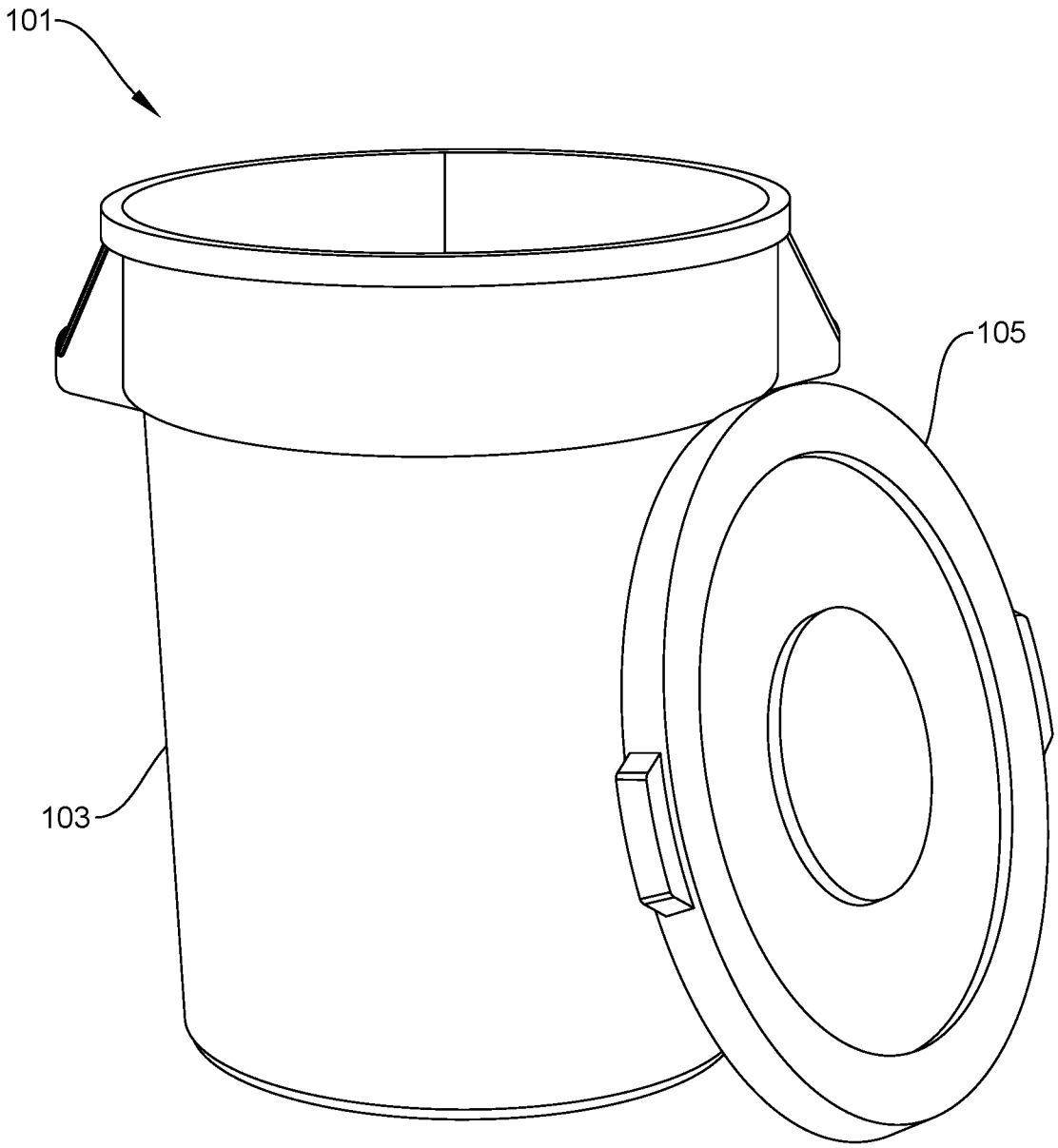
FIG. 1 (Prior Art)
FIG. 1 is a front view of a common trashcan.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional trashcans. Specifically, the present invention provides a means to connect a smart phone to the trashcan to allow the user to continue a conversation. In addition, the present invention provides a hook to allow for easy dumping of the trashcan into a dumpster. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
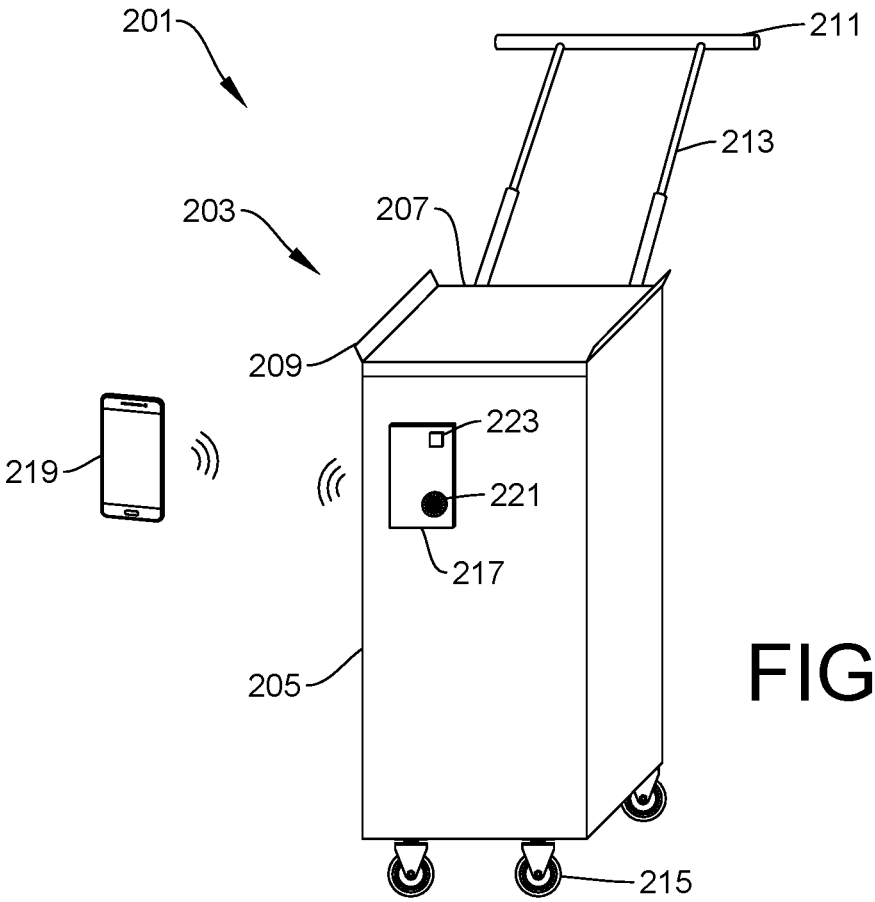
FIG. 2 is a front view of a trashcan system in accordance with a preferred embodiment of the present application.

Referring now to the drawings wherein like reference characters identify corresponding or similar elements throughout the several views, FIG. 2 depicts a front view of a trashcan system 201 in accordance with a preferred embodiment of the present application. It will be appreciated that system 201 overcomes one or more of the above-listed problems commonly associated with conventional trashcans.

In the contemplated embodiment, system 201 includes a trashcan 203 having a body 205 with a lid 207 attached thereto, thereby forming an interior cavity to receive waste. In some embodiments, lid 207 includes one or more lips 209 extending therefrom. It should be appreciated that the lips 209 allow for multiple trashcans to be stacked on top of one another securely. Trashcan 203 further includes a handle 211 configured to extend and retract via one or more extension devices 213, such as a telescoping. Further, trashcan 203 includes one or more wheels 215, having 360 degrees of rotation.

System 201 further includes a control system 217 having a transceiver and configured to wirelessly communicate with a smart device 219, such as a phone, tablet, computer, watch, or the like. In the preferred embodiment, control system 217 includes one or more speakers 221 and is configured to automatically detect smart device 219 within a predetermined distance. The control system 217 is configured to automatically connect and begin transmitting through speaker 221, thereby allowing for the user to continue a phone call or the playing of music or the like. In some embodiments, control system 217 can further include a port 223, such as a USB port to allow the user to connect smart device 219 via wires or charge control system 217.

It must further be understood and appreciated that control system can include buttons, batteries, and any other necessary components to function. It should further be appreciated that the smart device can connect via any means known in the art, such as Bluetooth, cellular, or any other means.

Figure 3:
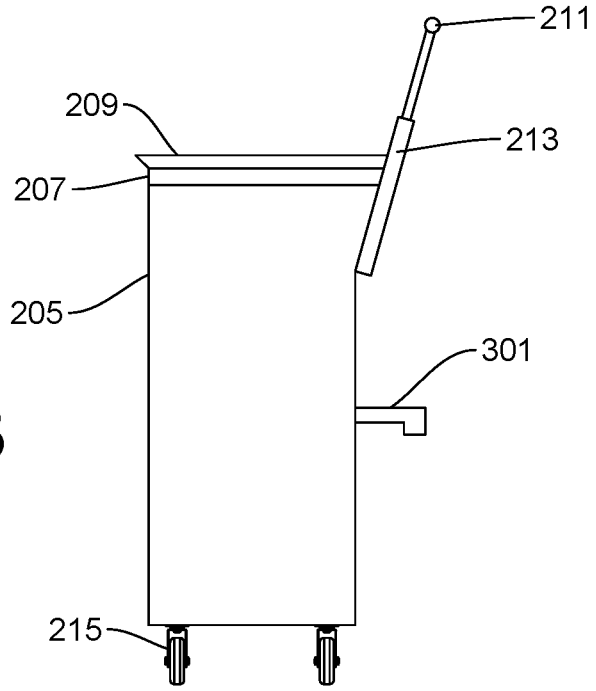
FIG. 3 is a side view of the trashcan of FIG. 2.

In FIG. 3, a side view of trashcan 203 is shown, wherein one or more hooks 301 are attached to a back surface of the trashcan. The one or more hooks 301 can vary in shape, but are configured to allow the user to engage with a ledge of a dumpster (or similar structure) to allow for easy emptying of the trashcan.

It should be appreciated that one of the unique features believed characteristic of the present application is the control system configured to automatically connect to a smart device to allow for the user to manipulate the trashcan and smart device hands free.

Figure 4:
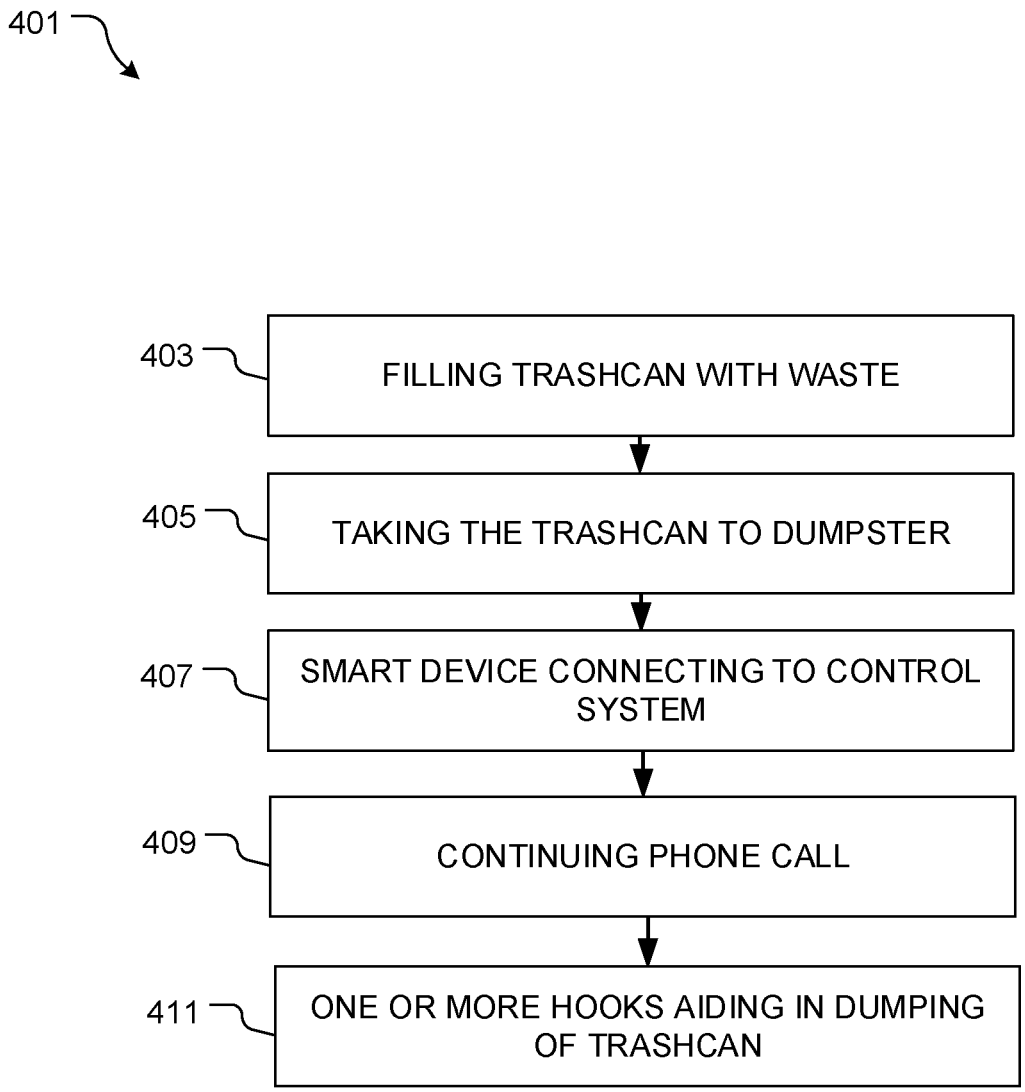
FIG. 4 is a flowchart of the method of use of the trashcan system of FIG. 2.

In FIG. 4, a flowchart 401 depicts the method of use of system 201. During use, the user fills the trashcan with waste as needed, as shown with box 403. As necessary, the user can take the trashcan to a dumpster, wherein the user's smart device will automatically connect to the control system, as shown with boxes 405, 407. The user can then proceed to empty the trashcan, while continuing a phone call or listening to audio content from the phone, as shown with box 409. Further, the one or more hooks extending from a back of the trashcan body can aid the user in dumping, as shown with box 411.

It should be appreciated that the trashcan body can vary in shape, and size, including a rectangular body or a circular body.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A trashcan system, comprising:
a body forming an interior cavity, the body extending from a bottom to a top;
a lid engaged with the body to enclose the interior cavity, the lid having an integrally attached lip extending away from the body, the integrally attached lip is configured to releasably engage with a second trashcan body;
a telescoping handle secured to the body;
a portable phone;
a control system secured to the body and having:
a speaker; and
a transceiver wirelessly connected to the portable phone;
wherein the control system is configured to wirelessly communicate with the portable phone via the transceiver;
wherein the control system activates playing of audio from the portable phone through the speaker when the portable phone is within a predetermined distance from the control system.

2. The system of claim 1, further comprising: one or more wheels secured to the body.

3. The system of claim 1, further comprising:
one or more hooks extending from a surface of the body;
wherein the one or more hooks aid in dumping the body into a dumpster.

4. A method of taking waste to a dumpster, the method comprising:
providing the system of claim 1;
placing waste within the interior cavity;
transporting the system to the dumpster; and
dumping the waste into the dumpster;
wherein the control system automatically connects to the portable phone to play audio through the speaker.

5. The system of claim 1, wherein the body further comprises:
a front surface;
a first side surface;
a second side surface; and
a back surface;
wherein the back surface has a first portion and a second portion, the first portion being parallel to the front surface and the second portion tapering outward from the first portion as the section portion extends to the top of the body;
wherein the top of the body has a width greater than the bottom of the body; and
wherein the body has an inconsistent rectangular cross section that extends from the top of the body to the bottom of the body.

6. The system of claim 1, further comprising:
the body having a front surface, a first side surface, a second side surface, and a back surface; and
the handle having a first attachment point and a second attachment point, the first attachment point and the second attachment point being secured to the back surface;
wherein the handle extends away from the top of the body at an angle greater than 90 degrees.

7. The system of claim 1, further comprising:
the lid being rectangular and extending from a front edge to a back edge and from a first side edge to a second side edge; and
the integrally attached lip having a first side and a second side, the first side running a first length of the first side edge of the lid and the second side running a second length of the second side of the lid.

* * * * *